US006540157B2

(12) United States Patent
Ophardt

(10) Patent No.: US 6,540,157 B2
(45) Date of Patent: Apr. 1, 2003

(54) NOZZLE FOR FLUID DISPENSER

(76) Inventor: Heiner Ophardt, 3931 Vineyard Crescent, Vineland, Ontario (CA), L0R 2C0

( * ) Notice: Subject to any disclaimer, the term of this patent is extended or adjusted under 35 U.S.C. 154(b) by 0 days.

(21) Appl. No.: 09/880,858

(22) Filed: Jun. 15, 2001

(65) Prior Publication Data

US 2002/0148912 A1 Oct. 17, 2002

(30) Foreign Application Priority Data

Apr. 12, 2001 (CA) ..... 2344185

(51) Int. Cl.[7] ..... E03C 1/08

(52) U.S. Cl. ..... 239/428.5; 239/318

(58) Field of Search ..... 239/398, 428.5, 239/302, 318

(56) References Cited

U.S. PATENT DOCUMENTS

| | | | | |
|---|---|---|---|---|
| 5,165,577 A | | 11/1992 | Ophardt | |
| 5,282,552 A | | 2/1994 | Ophardt | |
| 5,489,044 A | | 2/1996 | Ophardt | |
| 5,676,277 A | | 10/1997 | Ophardt | |
| 5,725,155 A | * | 3/1998 | Grunenberg et al. | 239/428.5 |
| 5,975,360 A | | 11/1999 | Ophardt | |

* cited by examiner

*Primary Examiner*—Christopher Kim
(74) *Attorney, Agent, or Firm*—Riches, McKenzie & Herbert LLP

(57) ABSTRACT

A nozzle for dispensing viscous fluid to avoid spraying and stringing, the nozzle including an inner tubular portion of a first cross-sectional area and an outer tubular portion of a second cross-sectional area, the inner tubular portion opening into the outer tubular portion and the outer tubular portion having an outlet, wherein fluid passes through the inner tubular portion into the outer tubular portion and subsequently out of the outer tubular portion via the outlet.

19 Claims, 9 Drawing Sheets

NOZZLE FOR FLUID DISPENSER

SCOPE OF THE INVENTION

This invention relates generally to a fluid dispenser and, more particularly, to an arrangement for a nozzle for a fluid dispenser.

BACKGROUND OF THE INVENTION

Pump assemblies for fluid dispensers are well known. Such pump dispenser includes those invented by the inventor of this present application including those disclosed in U.S. Pat. No. 5,165,577 issued Nov. 24, 1992, U.S. Pat. Nos. 5,282,552; 5,489,044; 5,676,277 and 5,975,360, the disclosures of which are incorporated herein by reference.

These fluid dispensers share a common characteristic with many other fluid dispensers that a fluid is to be dispensed out of an outlet with the outlet forming an open end of a tubular member. In applications of greatest interest to the present invention, the tubular member has its outlet opening downwardly and fluid passing through the tubular member is drawn downwardly by the forces of gravity with a stream of the fluid to become separated from the outlet of the nozzle and to drop downwardly therefrom.

The present inventor has appreciated that a number of difficulties arise with such nozzles particularly when the fluid to be dispensed is viscous.

For example, in dispensing liquid honey, the present inventor has appreciated that a difficulty arises such that after dispensing a quantity of honey, an elongate string of honey is formed which extends continuously from honey in the nozzle.

With other fluids and particularly with those having relatively high surface tension and/or viscosity such as relatively thick hand soaps and with some ketchup and mustard, a difficulty arises that after disposing fluid, fluid can remain in the outlet such that the outlet is partially or fully filled with the fluid. Over time, the fluid can harden, typically at least partially blocking the outlet. Later, dispensing may be prevented or, alternatively, may give rise to any fluid being dispensed being sprayed in an undesired direction through a remaining opening through the outlet past the hardened fluid.

SUMMARY OF THE INVENTION

To at least partially overcome these disadvantages of previously known devices, the present invention provides an improved nozzle for a fluid dispenser which has an outlet portion offering increased area for flow therethrough. Preferably, the nozzle comprises an outer tubular member which has an increased cross-section to provide an enlarged outlet. Apertures may be provided to permit air to enter the enlarged portion above the outlet, as in a venturi type relation.

An object of the present invention is to provide a nozzle for a fluid pump which facilitates dispensing viscous fluids such as relatively thick hand soaps, honey, ketchup, mustard and other fluids with a high viscosity.

Another object is to provide a nozzle for a fluid pump for dispensing fluids which have a tendency, typically after extended non-use, to remain adhered to a nozzle outlet and at least partially block the nozzle as by drying and hardening of the fluid in the nozzle outlet with exposure to air.

Another object is to provide a piston for a pump assembly which piston is adapted to dispense viscous fluids and may be formed as a unitary piece of plastic for ease of disposal.

Accordingly, in one aspect, the present invention provides a nozzle for dispensing fluid, the nozzle including an inner tubular portion of a first cross-sectional area and an outer tubular portion of a second cross-sectional area, the inner tubular portion opening into the outer tubular portion and the outer tubular portion having an outlet, wherein fluid passes through the inner tubular portion into the outer tubular portion and subsequently out of the outer tubular portion via the outlet.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
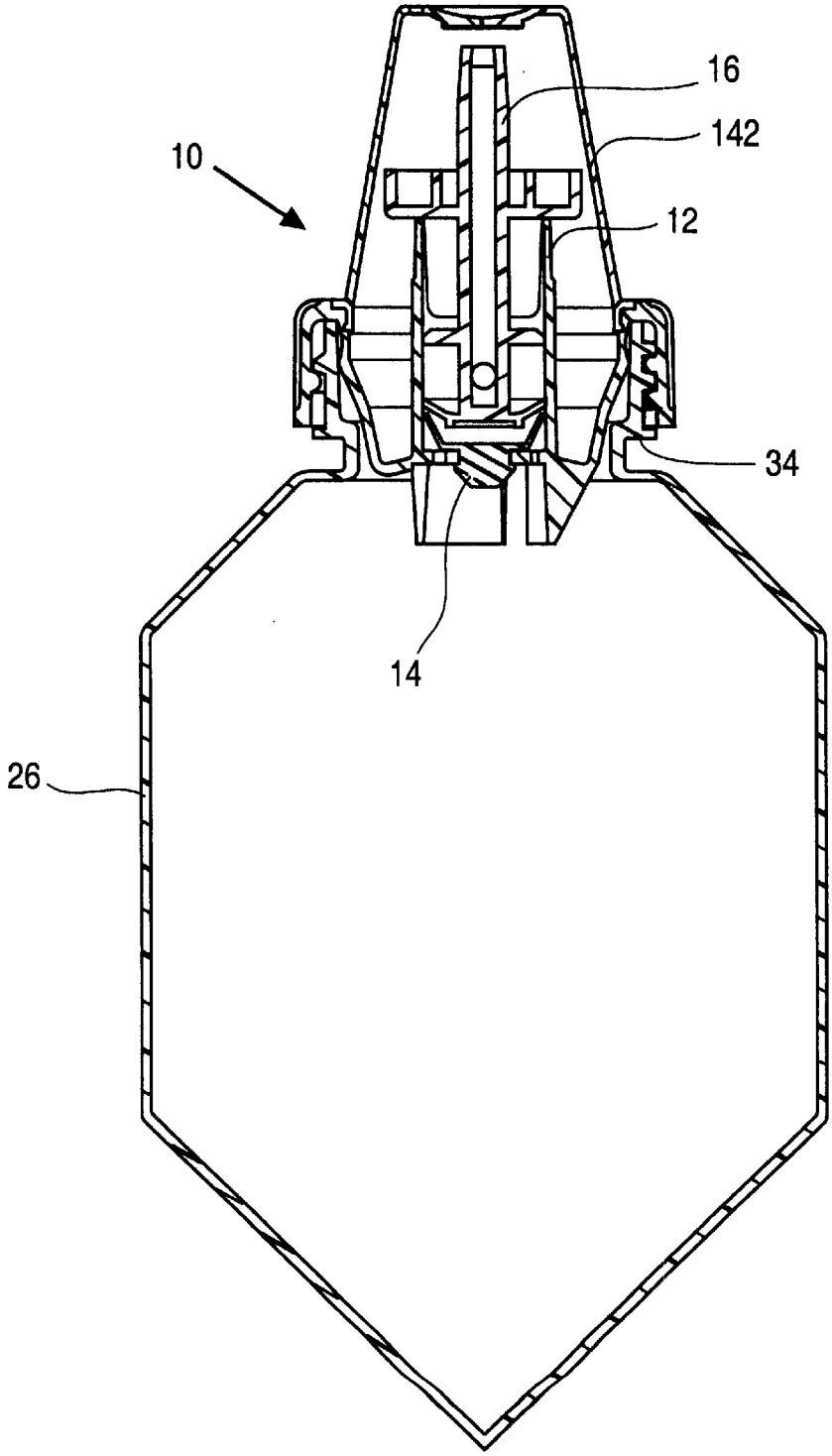
Figure 1 (Prior Art )
FIG. 1 is a cross-sectional side view of a prior art three-piece pump of the type disclosed in U.S. Pat. No. 5,489,044.
Figure 2:
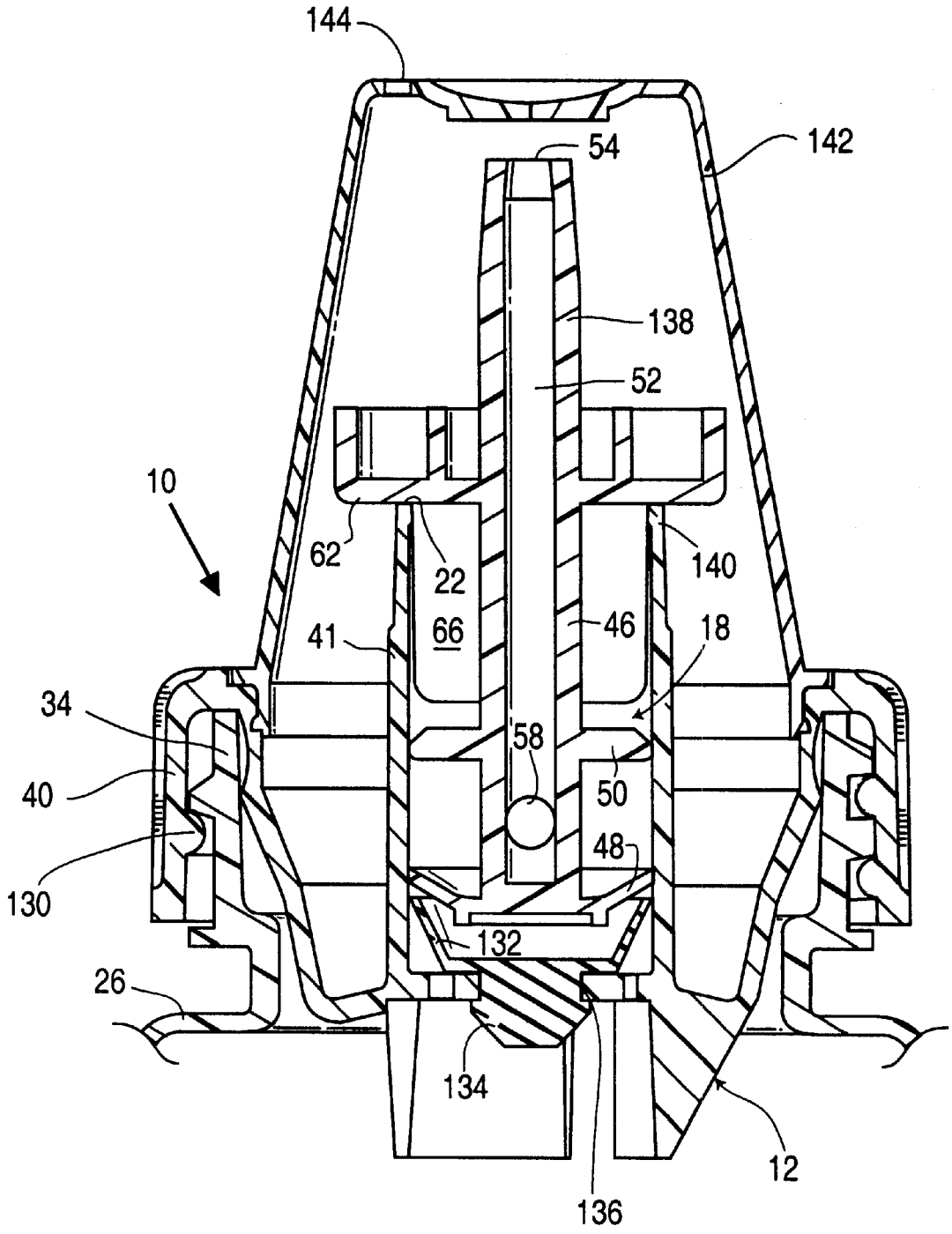
Figure 2 (Prior Art)
FIG. 2 is an enlarged view of the prior art pump assembly shown in FIG. 2.

Reference is made first to a prior art device shown in FIGS. 1 and 2 and comprising a pump assembly 10 secured to a collapsible plastic container 26 having a threaded neck 34. The pump assembly has a body 12, a one-way valve 14 and a piston 16.

The body 12 provides a cylindrical chamber 18 in which the piston 16 is axially slidable between a retracted and an extended position so as to draw fluid from within the container 26 and dispense it out of the outlet 54.

The piston 16 has a stem 46 carrying a flexing disc 48, a sealing disc 50 and locating webs 66. The stem 46 comprises a tubular member and can be seen to have a passage 52, the outlet 54 and an inlet 58. The inlet 58 is disposed between the flexing disc 48 and the sealing disc 50.

The one-way valve 14 comprises a unitary piece of resilient material having a resilient, flexible, annular rim 132 for engagement with the side wall of the chamber 18. The one-way valve is integrally formed with a shouldering button 134 which is secured in a snap-fit inside an opening 136 and a central bottom of the chamber 18.

An engagement flange 62 is provided on the stem 46 for engagement to move the piston 16 inwardly and outwardly. The engagement flange also serves the function of a stopping disc to limit axial inward movement of the piston 16 by engagement with the outer end 22 of the chamber 18. The stem 46 is shown to extend outwardly as a relatively narrow tube 138.

The body 12 carries an outer cylindrical portion 40 carrying threads 130 to cooperate with threads formed on the threaded neck 34 of the container 26. A removable cover 142 fits in a snap engagement onto body 12. In both FIGS. 1 and 2, the pump assembly is shown in a storage position inverted prior to use. For use, the cover 142 is removed and the pump is preferably inverted such that the outlet 54 is directed downwardly.

Figure 3:
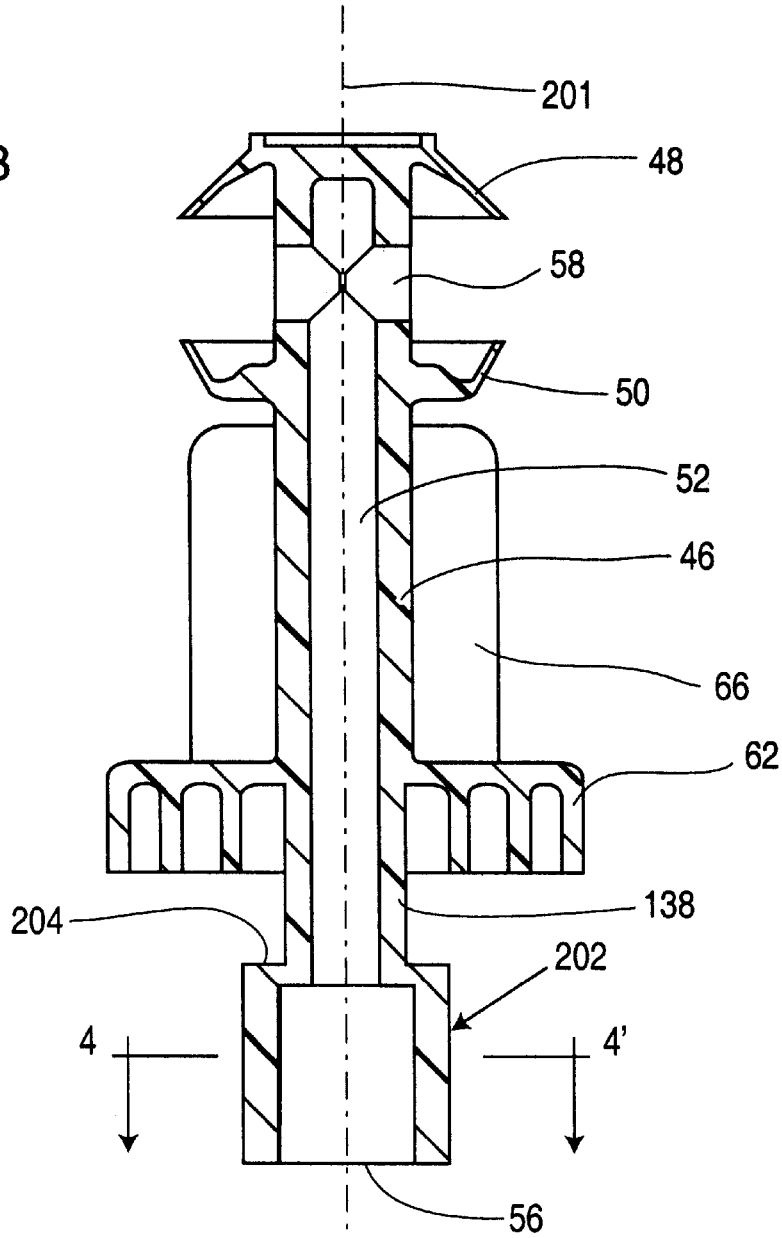
FIG. 3 shows a piston for a fluid pump having an improved nozzle in accordance with a first embodiment of the present invention.
Figure 4:
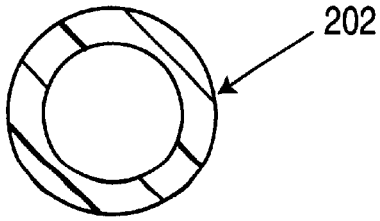
FIG. 4 is a cross-sectional view along section line 4–4' in FIG. 3.
Figure 5:
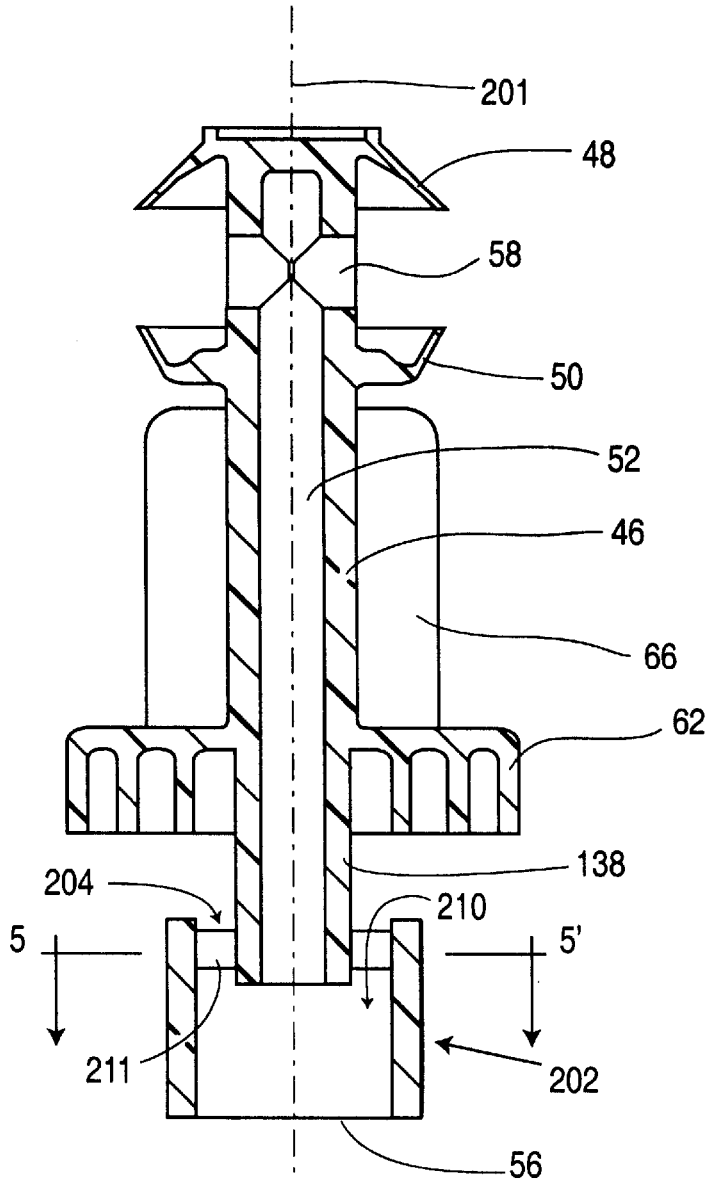
FIG. 5 shows a piston for a fluid pump having an improved nozzle in accordance with a second embodiment of the present invention.
Figure 6:
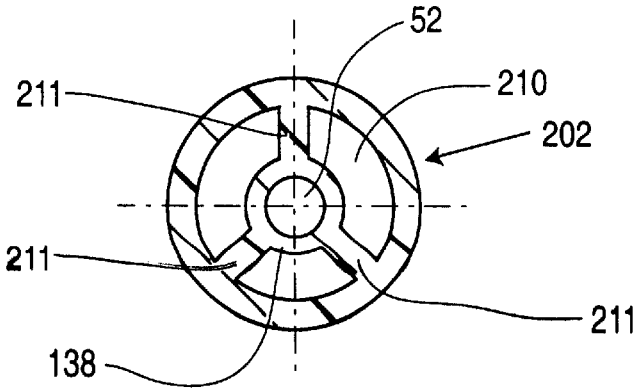
FIG. 6 is a cross-sectional view along section line 5–5' in FIG. 5.
Figure 7:
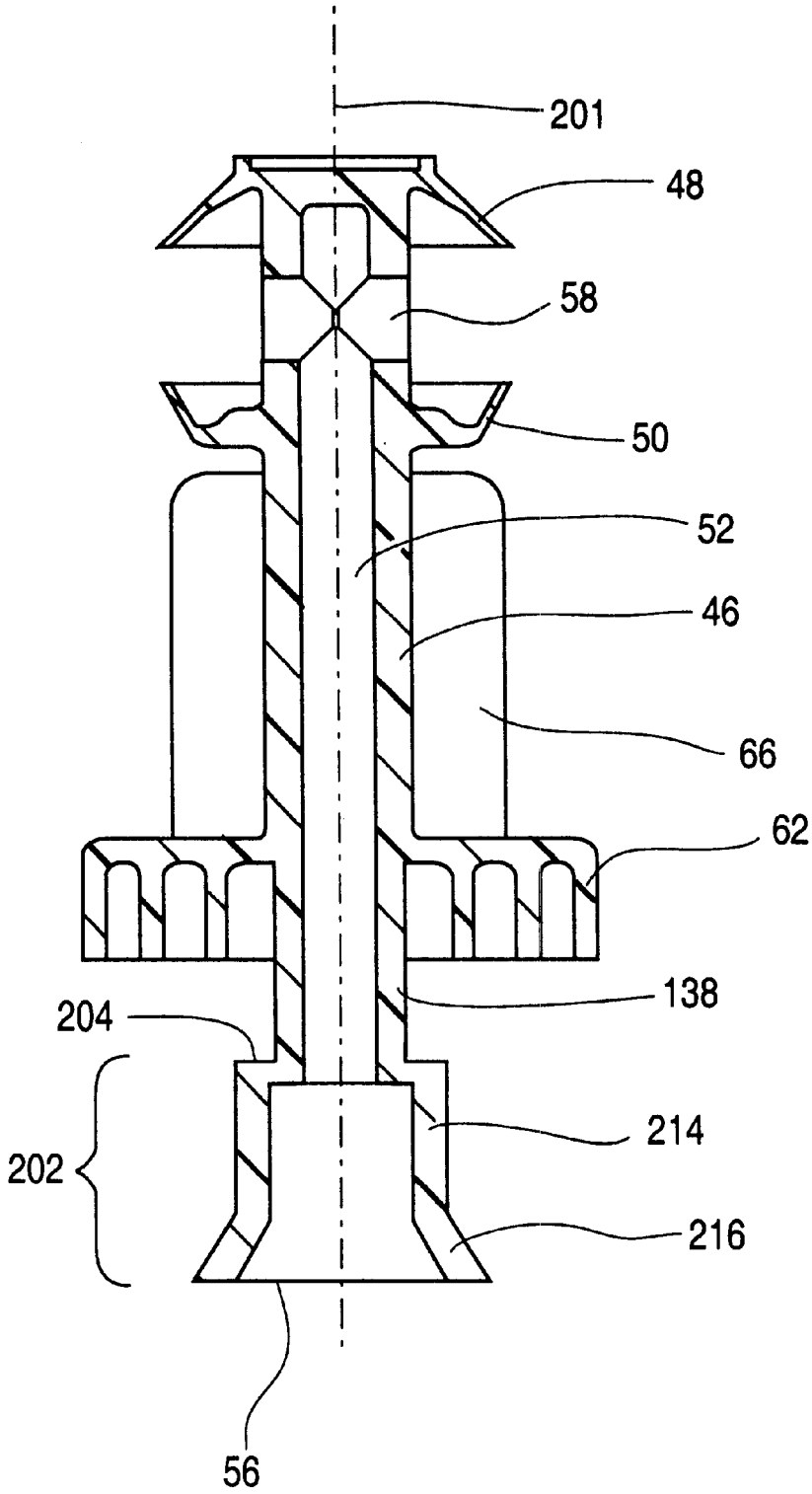
FIG. 7 shows a piston for a fluid pump having an improved nozzle in accordance with a third embodiment of the present invention.

Reference is now made to FIGS. 3 to 11 which show embodiments of a piston in accordance with the present invention. Each of these pistons shown in FIGS. 3, 5 and 7 are intended to replace the piston 16 shown in FIGS. 1 and 2. Each of the pistons shown in FIGS. 3, 5 and 7 have substantially identical elements to those shown for the piston 16 in FIGS. 1 and 2 and identical reference numerals are used to refer to identical elements. In this regard, each of the pistons 16 shown in FIGS. 3, 5 and 7 have the stem 46 which extends outwardly as a relatively narrow tube 138 and has a passage 52, an outlet 54 and an inlet 58.

Referring now to the first embodiment of the present invention as shown in FIG. 3, the stem 46 includes a narrow tube 132 which opens into the interior of the enlarged outlet portion 202. Preferably as shown, both the narrow tube 138 and the enlarged outlet portion 202 are cylindrical and coaxial about a longitudinal center axis 201 through the stem 46. A radially extending shoulder 204 extends radially outwardly at an inner end of the enlarged outlet portion 202. The outer end of the enlarged outlet portion 202 opens as the outlet 56 to permit fluid to pass therethrough. The cylindrical configuration of the enlarged outlet portion 202 is clearly seen in the cross-section of FIG. 4.

Reference is made to a second embodiment of the present invention shown in FIG. 5 which is similar to that shown in FIGS. 3 and 4 and having an enlarged outlet portion 202 at the outer end of the narrow tube 138 of the stem 46. The embodiment of FIG. 5 differs from that of FIG. 3 insofar as the radially extending shoulder 204 is provided with a plurality of air inlet openings 210. The air inlet openings 210 are effectively separated by radially extending circumferentially spaced ribs 211 which extend from the outside of the narrow tube 138 to the inside of the enlarged outlet portion 202 as may be best seen in FIG. 6.

Reference is made to FIG. 7 which shows a third embodiment of the present invention which is substantially identical to the embodiment shown in FIG. 3, however, the enlarged outlet portion 202 is shown to be formed as comprising a cylindrical section 214 and a flared section 216. The narrow tube 138 opens into the cylindrical section 214 which in turn opens outwardly into the flared section 216. Over the flared section, the internal diameter of the enlarged outer portion 202 increases towards the outlet 56.

Figure 8:
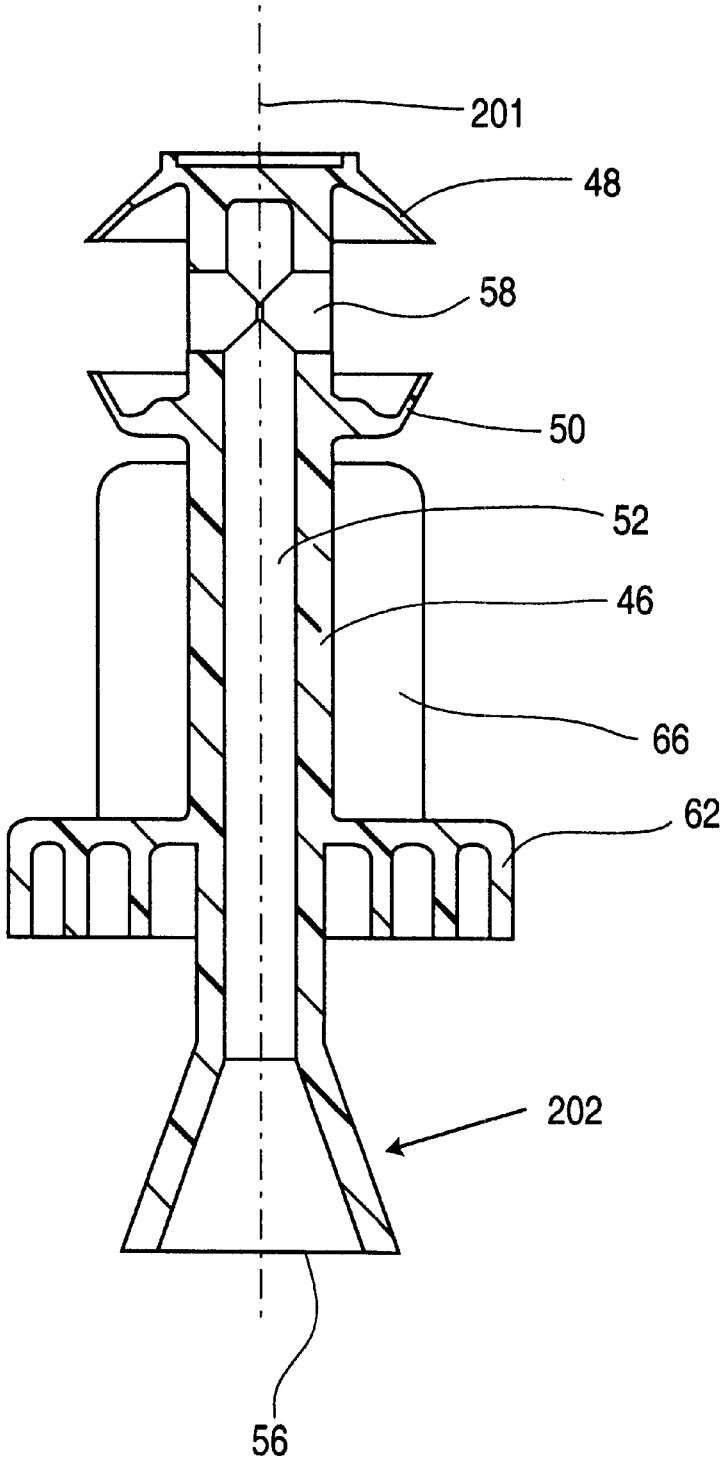
FIG. 8 shows a piston for a fluid pump having an improved nozzle in accordance with a fourth embodiment of the present invention.

Reference is made to FIG. 8 which shows a fourth embodiment of the present invention which is substantially identical to the embodiment shown in FIG. 3, however, the enlarged outer portion 202 is flared, that is, frustoconical enlarging towards outlet 56.

The enlarged outlet portion 202 may be coupled onto the narrow tube 138 in many manners. It is preferred that the cross-sectional area of the outlet portion 202 increase in a sudden stepped manner as shown in FIGS. 3 to 7, although this is not necessary.

Figure 9:
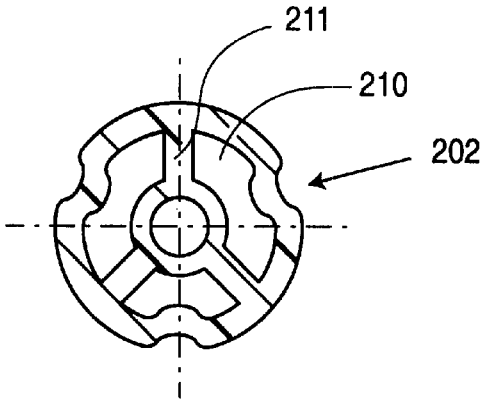
FIG. 9 is a cross-sectional view along section line 5–5' in FIG. 5 but showing a fifth embodiment of the present invention.

Each of the embodiments shown have the narrow tube 138 and enlarged outlet portion 202 as circular in cross-section about the axis 208. It is to be appreciated that this is not necessary. For example, FIG. 9 is an alternative cross-section along section line 5–5' in FIG. 5 showing a fifth embodiment in which the side wall 218 forming the enlarged outlet portion 202 is not cylindrical but rather is fluted.

Figure 10:
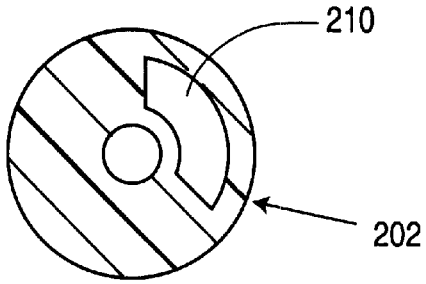
FIG. 10 is a cross-sectional view along section line 5–5' in FIG. 5 but showing a sixth embodiment of the present invention.
Figure 11:
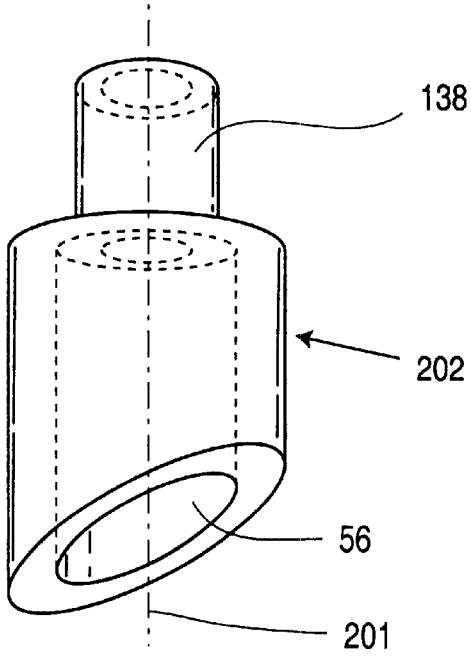
FIG. 11 is a schematic pictorial view of a nozzle in accordance with a seventh embodiment of the present invention.

FIG. 10 is an alternative cross-section along section line 5–5' in FIG. 5 showing a sixth embodiment identical to FIG. 6 with the exception that merely one air inlet opening 210 is provided asymmetrically relative to the axis 201 so as to provide an air inlet opening only on one side of the enlarged outlet portion 202. This configuration is believed to be advantageous with viscous fluid so as to assist in providing enhanced release of the fluid commencing on the side of the enlarged outlet portion 202 which has the air inlet opening 210. The air inlet opening 210 shown in FIG. 10 is shown as encompassing about one-quarter of the circumference, it is to be appreciated that the air openings may asymmetrically arranged circumferentially about the axis 201. The air openings could be provided, for example, over a circumferential extent of possibly as great as 330° about the circumference to as low as desired, preferably, to as low as 30° about the circumference.

In each of the embodiments described, the outlet opening 56 is disposed in a plane which extends normal to the axis 201. It is to be appreciated that the outlet opening 56 and particularly the axially directed end of the side wall of the enlarged outlet portion 202 need not be disposed in such a plane. Firstly, the side wall outlet opening may be disposed at an angle to the axis 204. Such an embodiment is simplistically illustrated in FIG. 11 which is a pictorial view showing merely a modified enlarged outlet portion 202 and its attached narrow tube 138 severed from the remainder of the piston.

Figure 12:
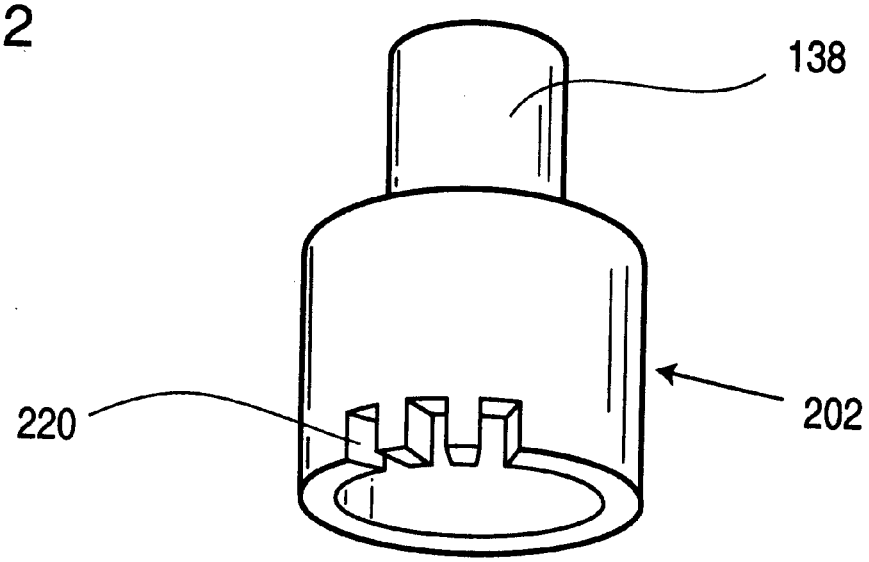
FIG. 12 is a schematic pictorial view of a nozzle in accordance with an eighth embodiment of the present invention.

Additionally, as shown in FIG. 12, which is a pictorial view of a narrow tube 138 and a modified enlarged outlet portion 202, the outer end of the enlarged outlet portion 202 need not lie in the same plane but may be castellated or have indentations or undulations as schematically illustrated as 220 in FIG. 12. Such indentations 22 preferably are selected so as to advantageously enhance earlier release of a viscous fluid from surfaces of the enlarged outlet portion 202 so as to, on one hand, enhance the release of the viscous fluid from selected portions of the enlarged outlet portion 202 and, on the other hand, increase the likelihood of adhesion of the fluid to other portions of the enlarged outlet portion 202 for an extended period of time.

The various features of the embodiments of the present invention may be preferably selected to meet various objectives including increasing the extent to which a viscous liquid such as honey may form a glob on one side of the enlarged outlet portion 202 which glob will tend to detach as a unit with the reduction of a stringing effect by which the fluid on dropping continues to be attached as a thin string to fluid remaining in the nozzle.

Figure 13:
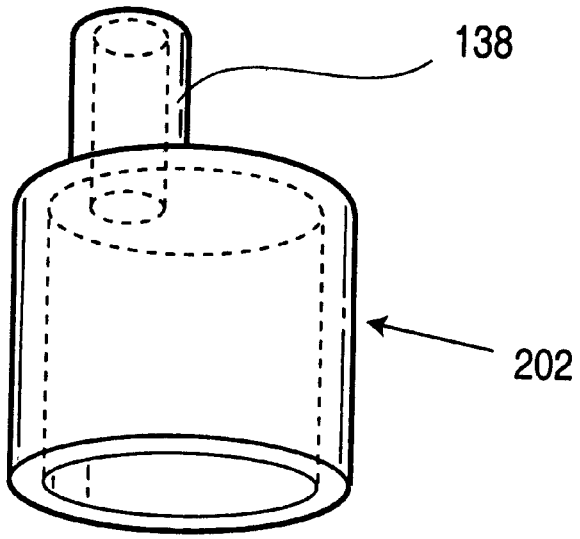
FIG. 13 is a schematic pictorial view of a nozzle in accordance with an ninth embodiment of the present invention.

The embodiments as illustrated in FIGS. 3 to 12 show the enlarged outlet portion 202 being coaxial with the narrow tube 138. This is not necessary and FIG. 13 shows an embodiment in which the enlarged outlet portion 202 is arranged asymmetrically on the narrow tube 138. In FIG. 13, the asymmetry is increased by reason of the outlet 56 being disposed at an angle to the axis and, as well, with an air inlet opening being provided in the shoulder 204 to one side of the narrow tube 138.

Figure 14:
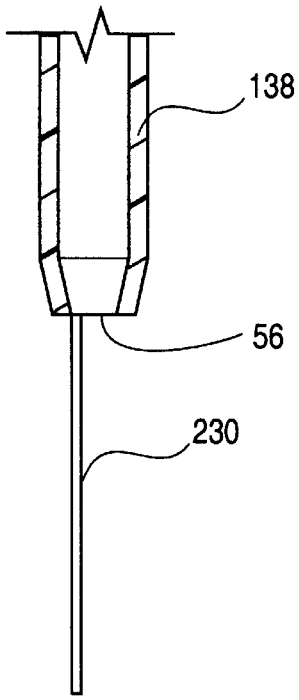
FIG. 14 is a schematic side view of a prior art nozzle of FIG. 2 illustrating a disadvantageous stringing phenomenon.
Figure 15:
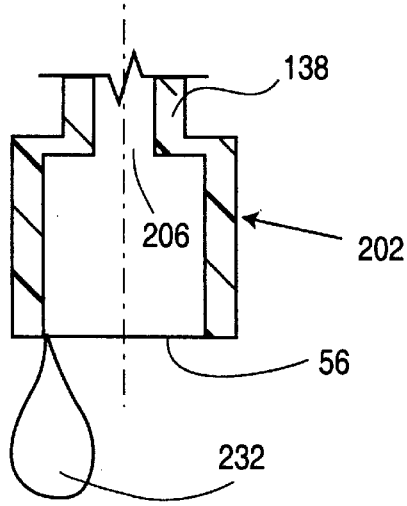
FIG. 15 is a schematic side view of a nozzle of FIGS. 5 and 6 illustrating a more preferred globule.

The phenomena of stringing is one in which when fluid dispensed from the nozzle, at the end of the pump stroke, continues to flow out from the nozzle, however, in a reduced quantity and forms a relatively thin string-like filament which, for an extended period of time, continues to flow downwardly with the viscosity and adhesion of the liquid to itself continuing to draw fluid from the outlet opening. Stringing can, for example, increase the time a user should keep his hand under a soap dispenser. Stringing can, for example, on removal of a person's hand cause the stringing to come into contact with other objects or surfaces than those desired. FIG. 14 schematically illustrates disadvantageous stringing from the tube 138 with a narrow string 230 of fluid extending from the outlet 56. FIG. 15 schematically illustrates a more preferred globule 282 as may be dropped from a nozzle of the type shown in FIGS. 5 and 6 with an enlarged outer portion 202.

In accordance with the present invention, the relative cross-sectional area of the narrow tube 138 may preferably be selected to be of a size having regard to the nature and viscosity of the fluid to be dispensed which will substantially retain the fluid therein. In contrast, the enlarged outlet portion 202 is preferably of an enlarged size to substantially prevent any fluid from remaining within the enlarged outlet portion 202. Therefore, having regard to the nature of the liquid to be dispensed, the narrow tube 138 can preferably be selected to be of relative cross-sectional area which will enhance the retention of fluid as by the surface tension to span the opening 206 at the outer end of the narrow tube 132. In contrast, the enlarged outlet portion 202 is preferably selected so as to have its outlet 56 of a size which will substantially resist the fluid being dispensed from adhering across the outlet 56. With preferred embodiments of the invention, the enlarged outlet portion 202 below the opening 206 effectively forms a portion where the fluid which is to drop downward out of the outlet 56 may come to be severed from fluid to remain retained within the tube 138. This arrangement assists in severing of the fluid which used to be dispensed and, hence, will assist in reducing difficulties with stringing.

As to the nature of the fluids which are preferable for use with the improved nozzle of the present invention, it is to be appreciated that the nozzle has increasing advantage with increasing viscosity. The nozzle may be advantageous for use with liquids of almost any viscosity, however, improvement in avoiding difficulties with stringing increases as the viscosity of the fluid is increased. Typically, difficulties with the stringing phenomenon do not occur with liquids which have viscosities comparable to that of water and lower.

Severance of the fluid being dispensed as discussed above can be aided by incorporating any one or more of the many features which have been discussed in the different embodiments shown in FIGS. 3 to 12.

Figure 16:
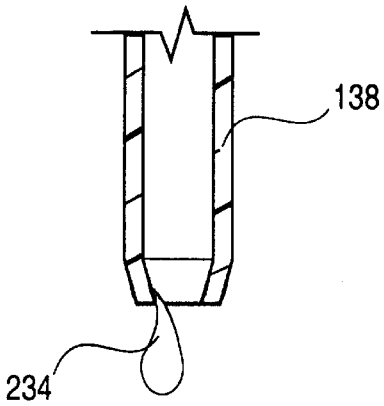
FIG. 16 is a schematic side view of a prior art nozzle of FIG. 2 illustrating a disadvantageous clogging fluid drop.
Figure 17:
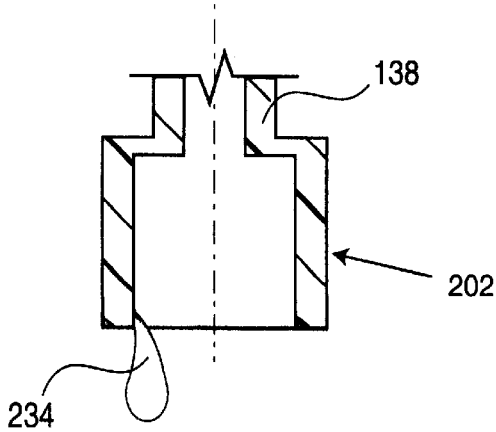
FIG. 17 is a schematic side view of a nozzle of FIGS. 5 and 6 illustrating a solidified fluid drop.

A difficulty which the applicant has appreciated which arises with prior art devices is the blocking or at least partial blocking of the outlet 56 of the narrow tube 138 in prior art devices as shown in FIGS. 1 and 2. For example, when fluid may drip out of the outlet 56, a drop of fluid may remain on the outlet 56 typically as a droplet 234 attached to the outlet 56 on one side of the tube as schematically illustrated in FIG. 16. This droplet will have increased exposure to air and may, after a period of non-use, come to become hardened and thereby form a restriction to fluid flow through the outlet 56. In accordance with the present invention, this difficulty is overcome insofar as a droplet 234 which will have a greater tendency to form about the outlet 54 of the enlarged outer tubular portion 202 as illustrated in FIG. 17 and will not restrict flow through the enlarged size outlet 56 such as great a proportion as in FIG. 16.

Fluid dispensers, such as soap dispensers, to which the present invention is directed, typically are to dispense a preferred dispensing unit as, for example, with a piston pump being a pre-set volume of fluid with each stroke of the piston through a preferred stroke length. Typically, dispensing unit volumes are in the range of 0.5 ml to 10 ml, more preferably, about 1.0 ml to 3 ml. A typical volume allotment for many soap dispensers is 1 ml. Preferably, the internal volume of the enlarged outlet portion 202 will be in relative proportion to the dispensing unit volume. Preferably, the internal volume of the enlarged outlet portion will not be greater than about two times the outlet portion 202 and, more preferably, not greater than about 1 time.

Preferably, the volume of the outlet portion 202 will be in the range of 0.1 to 1.25 times the dispensing unit volume, more preferably, in the ranges of 0.1 to 0.6 times and 0.25 to 0.50. Preferably, the volume of the enlarged outlet portion 202 is not greater than 0.60 times the dispensing unit volume, more preferably, not greater than 0.50 times or greater than 0.25 times.

Preferred nozzles in accordance with the present invention have the narrow tube 138 with a bore, the first bore in the range of 1 to 10 mm or 2 to 10 mm, more preferably, 2 to 5 mm, more preferably, 2 to 3 mm. Preferably, the first bore is not greater than 5 mm and, more preferably, not greater than 3 mm.

Such preferred nozzles have the enlarged outlet portion 202 with a second bore having an average diameter which is between 0.5 and 5 times greater than the diameter of the first bore of the narrow tube 138. Preferably, the second bore is 0.5 to 2 times or 2 to 5 times greater than the diameter of the first bore.

The preferred nozzles have the enlarged outlet portion 202 with an average length measured parallel the axis 201 in the range of about 0.5 to 10 times its diameter, more preferably, in the range of about 1 to 5 times its diameter.

The enlarged outlet portion 202 functions as a protective shroud to prevent any high velocity fluid being sprayed laterally from the end of the narrow tube 38 from exiting laterally out of the outlet 56. Preferably, any fluid which is sprayed laterally from the end of the narrow tube 138 as if, for example, the end of the narrow tube 138 is partially blocked, flows into contact with the interior side walls of the enlarged outlet portion 202 and directed generally axially at lower velocity out of the outlet 56.

Pump assemblies, as shown in FIGS. 1 and 2 with a piston as shown in FIGS. 3 and 4, were tested with pumps having a dispensing unit volume of 1.0 ml for about 17 mm stroke of the piston; the first bore narrow tube 138 having a diameter of 3 mm, the second bore of the enlarged outlet portion 202 having a diameter of about 5 mm and lengths of about 12.5 mm, 19 m and 26 mm representing volumes of the enlarged outlet portions of roughly ½, ¼ and ⅓ of the dispensing unit volume of 1.0 ml.

With the nozzles tested, difficulties with stringing improved with viscous fluids tested.

The nozzle in accordance with the present invention is preferred for use with viscous fluids of viscosities greater than that of water, i.e. 1.0 centipoises at 20° C. Preferably, the fluids will have viscosities greater than 1.5 centipoises, greater than 2.0 centipoises or greater than 5.0 centipoise.

Having regard to the nature of the fluid which is to be dispensed, the piston shown in the preferred embodiment and, particularly, the nozzles thereof may be formed from various materials adapted to have preferred release properties for the fluid being dispensed.

In the configuration shown in FIG. 5, the tubular outer portion 202 can comprise a separate tube which is secured to the end of the inner tube 138. This permits the outer tubular portion 202, if desired, to be formed from a different plastic material which may have enhanced property so as to reduce the adhesion of the fluid thereto.

Preferred plastic materials from which the piston and/or its outer tubular portion may be formed include silicone containing plastic materials and vinyl plastics.

While the invention has been described with reference to preferred embodiments, many modifications and variations will now occur to those skilled in the art. For a definition of the invention, reference is made to the following claims.

I claim:

1. A fluid pump comprising a piston chamber forming member having an inner end and an outer end, the inner end to be placed in fluid communication with a source of fluid, a piston forming element received in the piston chamber forming member axially slidable inwardly and outwardly therein, the piston forming element having an axially extending hollow stem which extends out of said outer end of the piston chamber forming member, the stem having a central passageway ending at a nozzle, the piston forming element cooperating with the piston chamber forming member whereby in a stroke of inward and outward reciprocal sliding of the piston forming element in the piston chamber forming member between a retracted position and an extended position the piston forming element pumps fluid from the inner end through the piston chamber forming member via the passageway in the stem and out the nozzle, the nozzle including an inner tubular portion and an outer tubular portion, the inner tubular portion having an opening opening into the outer tubular portion and the outer tubular portion having an outlet, wherein a fluid passageway is formed passing through the inner tubular portion into the outer tubular portion and subsequently out of the outer tubular portion via the outlet, the outlet of the outer tubular portion is directed generally vertically downwardly, the opening of the inner tubular portion is directed generally vertically downwardly in alignment with the outlet of the outer tubular portion, the inner tubular portion having a maximum cross-sectional area for flow therethrough smaller than a minimum cross-sectional area for flow through the outer tubular portion.

2. A pump as claimed in claim 1 wherein the pump dispenses through the inner tubular portion a unit volume of fluid on each stroke of the piston forming element, the outer tubular portion defining a volume in the range of 0.1 to 2 times the unit volume.

3. A pump as claimed in claim 2 wherein the inner tubular portion comprises a cylindrical tube having a first bore therethrough of a first diameter and the outer tubular portion comprises an outer tube having a second bore therethrough of a second diameter larger than the diameter of the first bore.

4. A pump as claimed in claim 3 wherein air inlet openings are provided opening into the outer tubular portion proximate a junction between the inner tubular portion and the outer tubular portion.

5. A pump as claimed in claim 4 wherein the inner tubular portion and outer tubular portion are coaxial about an axis.

6. A pump as claimed in claim 3 wherein the outer tubular portion is a hollow tube open throughout its length to the outlet and the passageway is defined therein free of any obstruction which would reduce or restrict flow of liquid out the outlet.

7. A pump as claimed in claim 1 wherein air inlet openings are provided opening into the outer tubular portion proximate a junction between the inner tubular portion and the outer tubular portion.

8. A pump as claimed in claim 7 wherein the air inlet openings are disposed about the inner tubular portion such that on flow of fluid out from the inner tubular portion into the outer tubular portion air is drawn inwardly into the outer tubular portion under a venturi effect.

9. A pump as claimed in claim 7 wherein the inner tubular portion comprises a cylindrical tube having a first bore therethrough of a first diameter and the outer tubular portion comprises an outer tube having a second bore therethrough of a second diameter larger than the diameter of the first bore.

10. A pump as claimed in claim 9 in which the diameter of the second bore is at least ⅔ the diameter of the first bore.

11. A pump as claimed in claim 9 wherein the diameter of the second bore is in the range of ⅔ to two times the diameter of the first bore.

12. A pump as claimed in claim 11 wherein the diameter of the first bore of the inner tube is in the range of two to ten millimeters.

13. A pump as claimed in claim 9 wherein the inner tubular portion and outer tubular portion are coaxial about an axis and the outlet of the outer tubular portion is disposed in a plane normal the axis.

14. A pump as claimed in claim 10 wherein the inner tubular portion and outer tubular portion are coaxial about an axis.

15. A pump as claimed in claim 2 wherein the volume of the outer tubular portion is in the range of 0.1 to 1 times the unit volume.

16. A pump as claimed in claim 2 wherein the volume of the outer tubular portion is in the range of ⅛ to ½ times the unit volume.

17. A pump as claimed in claim 9 wherein a radially extending shoulder joins an outer end of the inner tubular portion and an inner end of the outer tubular portion such that the cross-sectional area of the passageway increases in a step function from the inner tubular portion into the outer tubular portion.

18. A pump as claimed in claim 17 wherein air inlet openings are provided through the shoulder into the outer tubular portion.

19. A pump as claimed in claim 9 wherein the outer tube is a cylindrical tube.

* * * * *